United States Patent [19]

Sakanoue et al.

[11] Patent Number: 4,513,079

[45] Date of Patent: Apr. 23, 1985

[54] SILVER HALIDE COLOR PHOTOGRAPHIC MATERIALS

[75] Inventors: Kei Sakanoue; Kozo Aoki, both of Kanagawa, Japan

[73] Assignee: Fuji Photo Film Co., Ltd., Kanagawa, Japan

[21] Appl. No.: 542,316

[22] Filed: Oct. 14, 1983

[30] Foreign Application Priority Data

Oct. 14, 1982 [JP] Japan ..... 57-180138

[51] Int. Cl.[3] ..... G03C 1/46

[52] U.S. Cl. ..... 430/502; 430/505; 430/506; 430/509; 430/552; 430/553; 430/558

[58] Field of Search ..... 430/551, 552, 553, 558, 430/506, 509, 502, 505

[56] References Cited

U.S. PATENT DOCUMENTS 4,333,999 6/1982 Lau ..... 430/553
4,409,321 10/1983 Onodera et al. ..... 430/506
4,427,767 1/1984 Aoki et al. ..... 430/552
4,434,225 2/1984 Sugita et al. ..... 430/553
4,444,872 4/1984 Kato et al. ..... 430/553
4,450,228 5/1984 Shimba et al. ..... 430/505
4,451,559 5/1984 Sato et al. ..... 430/558

*Primary Examiner*—J. Travis Brown
*Attorney, Agent, or Firm*—Sughrue, Mion, Zinn, Macpeak, and Seas

[57] ABSTRACT

A silver halide color photographic material is disclosed. The material is comprised of a support base having provided thereon a fine grain silver halide emulsion layer and, positioned adjacent to the fine grain silver halide emulsion layer, a silver halide emulsion layer containing a coupler. The coupler is a phenolic cyan coupler substituted at the 5-position with an acylamino group and at the 2-position with an ureido group. The material has high sensitivity and good granularity. The material produces an image which has excellent fastness to light and heat.

6 Claims, No Drawings

SILVER HALIDE COLOR PHOTOGRAPHIC MATERIALS

FIELD OF THE INVENTION

This invention relates to color photographic materials containing an ureido type cyan dye-forming coupler and a fine grain silver halide emulsion.

BACKGROUND OF THE INVENTION

In general silver halide photographic materials, a color reproduction process by subtractive color process is employed, and in order to reproduce blue, red and yellow, this process utilizes coloring dye images of yellow, magenta and cyan which are the corresponding complementary colors, respectively.

Among them, the cyan dye image is produced by a cyan dye which is formed by coupling an oxidized product of an aromatic primary amine developing agent contained in a developer with a cyan dye-forming compound (hereinafter called a cyan coupler). Hitherto, phenols or naphthols have been used as cyan couplers.

The color images obtained from these cyan couplers, however, have several problems with respect to stability.

For example, a color image obtained from 2-acylaminophenolic cyan coupler which is described in specifications of U.S. Pat. Nos. 2,367,531 and 2,423,730 is generally inferior in fastness to heat, a color image obtained from 2,5-diacylaminol cyan coupler which is described in specifications of U.S. Pat. Nos. 2,369,929 and 2,772,162 is generally inferior in fastness to light, and 1-hydroxy-2-naphthamide cyan coupler is generally insufficient in fastness to both light and heat.

Couplers which have improved on these points include phenolic cyan couplers having an ureido group at the 2-position which are described in specifications of U.S. Pat. Nos. 3,446,622, 3,996,253, 3,658,308 and 3,880,661 and Japanese Patent Application (OPI) No. 65134/81 (the term "OPI" as used herein refers to a "published unexamined Japanese patent application"). In comparison with other general cyan couplers mentioned above, these couplers are much improved with respect to their fastness to light and heat.

However, for the reasons described below, the phenolic cyan couplers having ureido groups have serious defects in which the coupling with an oxidized product of a developing agent formed in a developer proceeds slowly. Accordingly, the sensitivity is lower than high-speed reactive cyan couplers as described in Japanese Patent Application (OPI) No. 1938/81, and disappearance of granularity becomes difficult to obtain, and so-called aggravation of granularity occurring with coloring of all the coated couplers, is also caused.

The reasons include (i) the dissociation equilibrium constant of the coupler is high, and in development, the concentration of the dissociated anion species which are active species of coupling reaction is low; (ii) as a bulky ureido group is situated at the ortho position adjacent to the coupling position, the steric hindrance becomes large, preventing the approach of the oxidized product of a developing agent.

Therefore, when attempting to use these couplers for photographing materials which require especially high sensitivity, they were insufficient in sensitivity. In order to fulfill the requirements relating to sensitivity, an increase in the amount of silver was required or silver halide grains having a large size were used which was accompanied by aggravation of granularity.

SUMMARY OF THE INVENTION

The inventors have shown that these problems can be solved by the addition of a fine grain silver halide emulsion to the layer adjacent to a red color sensitive emulsion layer containing a phenolic cyan coupler which is substituted by an ureido group. This improves the sensitive insufficiency caused by the above-mentioned low reactivity and results in better granularity, thus making it possible to provide color photographic materials with high sensitivity and good granularity. These materials produce images which maintain excellent fastness to light and heat which is the outstanding characteristic of ureido type couplers.

This invention is embodied as a silver halide color photographic material characterized by containing a cyan coupler which is substituted by an acylamino group at the 5-position and by an ureido group at the 2-position in at least one layer of silver halide emulsion layers coated on a support, and containing a fine grain silver halide emulsion in the layer adjacent to the cyan coupler-containing emulsion layer.

DETAILED DESCRIPTION OF THE INVENTION

The fine grain silver halide emulsion may be contained in a non-photographic internal layer or photographic emulsion layer, either of which is adjacent to the emulsion layer containing the above cyan coupler. However, from the view point of efficiency, it is more preferably contained in a non-photographic internal layer.

The most preferable cyan coupler that can be used in this invention is represented by the following general formula (I)

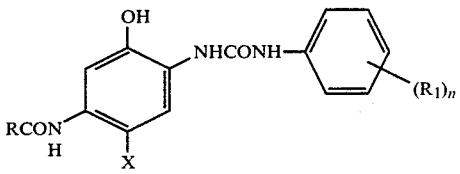

(I)

wherein R represents an alkyl group, an aryl group or a heterocyclic group, which may be substituted, $R_1$ represents a group selected from a hydrogen atom, a halogen atom, a sulfonyl group, a sulfonamide group, a sulfamoyl group, a polyfluoroalkyl group, an acyl group, an alkoxycarbonyl group, an acylamino group and a cyano group, n represents an integer of 1 to 5, $R_1$ may be the same or different when n is two or more, and X represents a group which can be eliminated at oxidative-coupling with a developing agent.

The above R and X in the general formula (I) are described in detail below.

In the general formula (I), R represents chain or cyclic alkyl group, preferably having 1 to 22 carbon atoms (e.g., methyl, butyl, pentadecyl, cyclohexyl groups, etc.), an aryl group (e.g., phenyl, naphthyl groups, etc.), preferably being a monocyclic aryl group, or a heterocyclic group (e.g., 2-pyridyl, 4-pyridyl, 2-furanyl, 2-oxazolyl, 2-imidazolyl groups, etc.), preferably being a 5- or 6-membered heterocyclic group constructed from at least one hetero atom such as nitrogen or oxygen and carbon atoms, and these groups may be substituted by substituents selected from alkyl, aryl, heterocyclic, alkoxy (e.g., methoxy, dodecyloxy, 2-methoxyethoxy groups, etc.), aryloxy (e.g., phenoxy, 2,4-di-tert-amylphenoxy, 3-tert-butyl-4-hydroxyphenoxy, naphthyloxy groups, etc.), carboxyl, carbonyl (e.g., acetyl, tetradecanoyl, benzoyl groups, etc.), ester (e.g., methoxycarbonyl, phenoxycarbonyl, acetoxy, benzoyloxy, butoxysulfonyl, toluenesulfonyloxy groups, etc.), amido (e.g., acetylamino, ethylcarbamoyl, methanesulfonylamido, butylsulfamoyl groups, etc.), imido (e.g., succinimido, hydantoinyl groups, etc.), sulfonyl (e.g., methanesulfonyl), hydroxyl, cyano, nitro groups, and a halogen atom.

Preferably, R represents an alkyl group.

In the general formula (I), X represents a hydrogen atom or a halogen atom (e.g., fluorine, chlorine, bromine atoms, etc.), and in addition, examples of a leaving group represented by X include an alkoxy group (e.g., ethoxy, dodecyloxy, methoxyethylcarbamoylmethoxy, carboxymethoxy, methylsulfonylethoxy groups, etc.), an aryloxy group (e.g., phenoxy, naphthyloxy, 4-carboxyphenoxy groups, etc.), an acyloxy group (e.g., acetoxy, tetradecanoyloxy, benzoyloxy groups, etc.), a sulfonyloxy group (e.g., methanesulfonyloxy, toluenesulfonyloxy groups, etc.), an amido group (e.g., dichloroacetylamino, heptafluorobutylylamino, methanesulfonylamino, toluenesulfonylamino groups, etc.), an alkoxycarbonyloxy group (e.g., ethoxycarbonyloxy, benzyloxycarbonyloxy groups, etc.), an aryloxycarbonyloxy group (e.g., phenoxycarbonyloxy group, etc.), and an imido group (e.g., succinimido, hydantoinyl groups, etc.).

Preferably, X represents a hydrogen atom, halogen atom, an alkoxy group or an aryloxy group.

In the general formula (I), $R_1$ preferably represents a halogen atom, a sulfonyl group, a sulfonamido group, a sulfamoyl group, a polyfluoroalkyl group, an acyl group, an alkoxycarbonyl group or an acylamino group, n is 1 or 2, and the preferable position of substituents is the m- or p-position with respect to the ureido group.

More preferably, $R_1$ represents a sulfonyl, sulfonamido, or sulfamoyl groups, and n is 1.

Specific examples of couplers which can be used according to the present invention are as follows.

1.

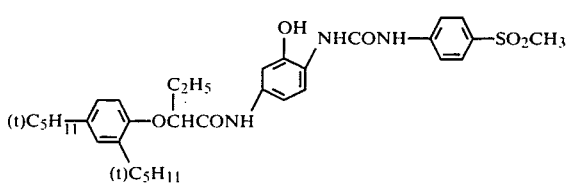

2.

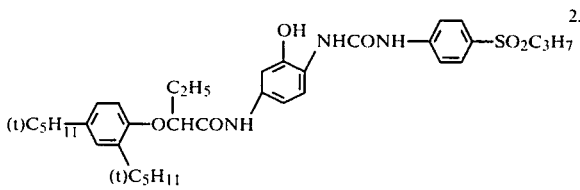

-continued

3.

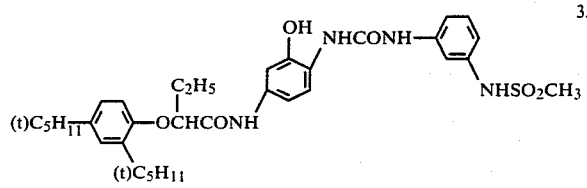

4.

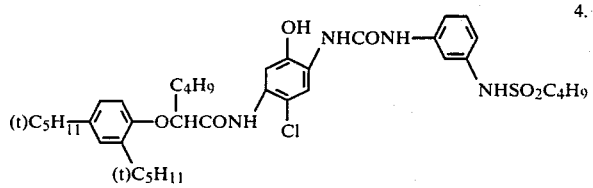

5.

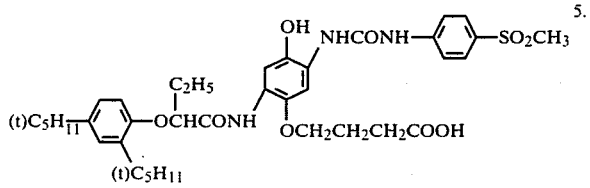

6.

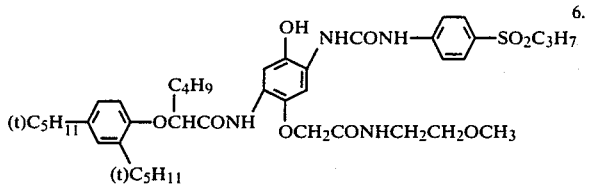

7.

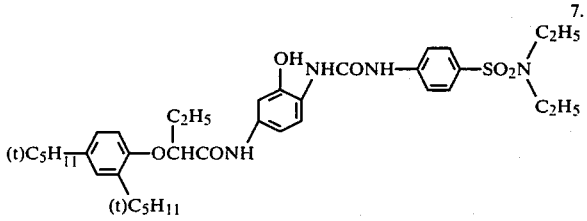

8.

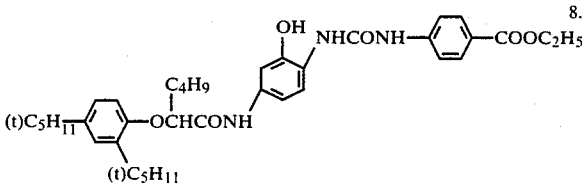

9.

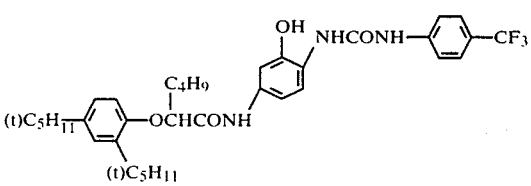

10.

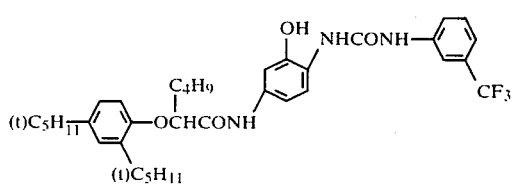

-continued

11.

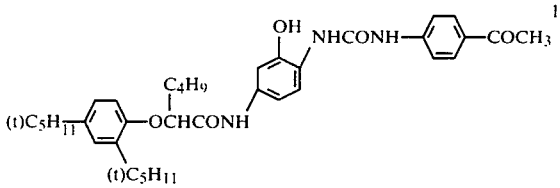

12.

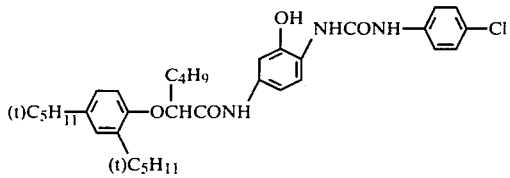

13.

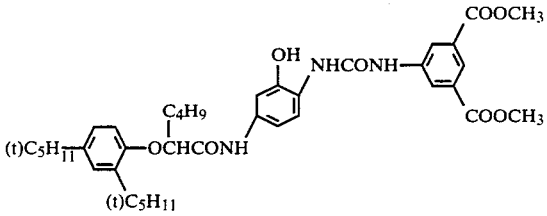

14.

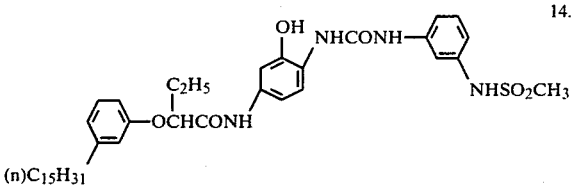

15.

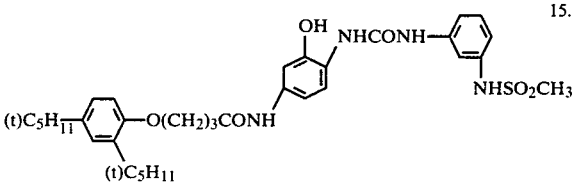

16.

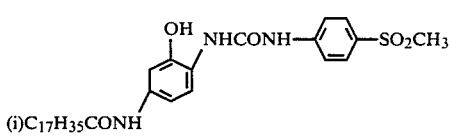

17.

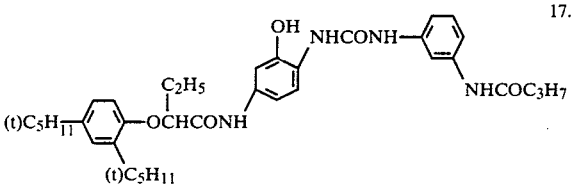

18.

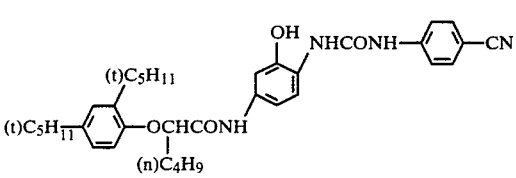

-continued

19.

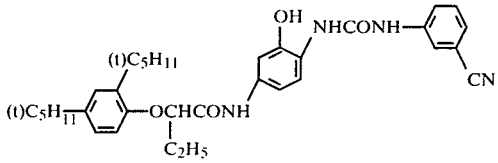

The typical synthetic examples of the couplers of this invention are shown below.

SYNTHESIS EXAMPLE 1

Synthesis of Illustrated Coupler (1)

(i) Synthesis of 2-(4-methylsulfonylphenylureido)-5-nitrophenol

4-Methylsulfonylaniline 19.3 g was dissolved in 60 ml of tetrahydrofuran and 11 ml of pyridine, then phenyl chloroformate 19.8 g was added dropwise to the solution under ice cooling. The mixture was stirred for 30 minutes and poured into ice water containing 12 ml of hydrochloric acid. The precipitate was filtered and dried to give 32.8 g of crystals.

The obtained crystals 32.8 g, 2-amino-5-nitrophenol 17.9 g and imidazol 0.8 g were suspended in xylene and the suspension was heated under reflux for 3 hours. After cooling, the precipitated crystals were filtered and dried to give 33.5 g of the titled compound.

(ii) Synthesis of Illustrated Coupler (1)

2-(4-Methylsulfonylphenylureido)-5-nitrophenol 32 g obtained in (i), reduced iron 30 g and ammonium chloride 2 g were added to isopropanol 200 ml and water 20 ml, and the mixture was heated under reflux for 3 hours. After cooling, a solution of sodium hydroxide 5.5 g in water 10 ml was added to the mixture, then iron powder was filtered off. The resulting solution was neutralized with acetic acid and the precipitate was filtered and dried to give 16.2 g of crystals.

The obtained crystals 14.6 g was dissolved in acetonitrile 100 ml, and 2-(2,4-di-tert-phenoxy)butanoylchloride 16.9 g was added dropwise to the mixture under heat-reflux. The mixture was refluxed for 2 hours. After cooling, the mixture was poured into water, extracted with ethyl acetate and washed with water, then the solvent was removed under reduced pressure. The obtained oil was crystallized from acetonitrile to give 20.0 g of the titled coupler (b.p. 129°–131° C.).

Elementary Analysis: Found: C: 65.21%; H: 7.03%; N: 6.91%. Calcd.: C: 65.46%; H: 7.27%; N: 6.74%.

The other couplers could be synthesized using a similar method to that of Sample coupler (1).

Boiling points of the typical couplers are as follows: (2) 130°–133° C., (3) 153°–155° C., (5) 130°–135° C., (7) 131°–132° C., (8) 88°–92° C., (9) 148°–151° C., (10) 155°–157° C., (12) 166°–167° C., (13) 189°–190° C., (14) 175°–176° C., (16) 135°–137° C., (17) 185°–187° C., (18) 166°–169° C., (19) 209°–211° C.

The fine grain silver halide emulsion used in this invention is preferred to be a silver iodobromide, silver bromide or silver chloride emulsion with the average grain size of 0.1 or less and iodine mol% of 1% or less. Also, as this emulsion does not require to be sensitized by exposure and developed, chemically ripened emulsions may be used. However, low photosensitive emulsions which are not ripened chemically are somewhat preferable.

The grains of these silver halide emulsions are prepared according to various preparation methods such as neutral method, semi-ammonia method, ammonia method and the like, and also according to various production forms such as double-jet mixing process, conversion process and the like. These silver halides are generally coated in an amount in the range of 0.01 g/m$^2$ to 1 g/m$^2$, preferably in 0.05 to 0.5 g/m$^2$.

The photographic emulsions which can be used in this invention, including emulsions to give photosensitivity, can be prepared using the methods described in the following literature: P. Glafkides, "Chimie et Physique Photographique" (published by Paul Montel, 1967); G. F. Duffin, "Photographic Emulsion Chemistry" (published by the Focal Press, 1966); V. L. Zelikman et al., "Making and Coating Photographic Emulsion" (published by the Focal Press, 1964). Namely, any of acidic method, neutral method and ammonia method may be employed, and as the form of reacting a solubilized silver salt with a solubilized halogen salt, any of single-jet mixing process, double-jet mixing process or the combination thereof may be used.

A process for forming grains in the presence of excess silver ions (so-called reversal-mixing process) can be also used. Moreover, as one form of double-jet mixing process, a process for keeping pAg in the liquid phase in which silver halide is produced constant, so-called controlled double-jet method, can be used.

This process affords a silver halide emulsion with regular crystal form and nearly uniform grain size.

A mixture of two or more kinds of silver halide emulsions separately prepared may be used.

In the process of the formation of silver halide grains or of their physical ripening, there may be co-existence of cadmium salt, zinc salt, lead salt, thallium salt, iridium salt or its complex salt, rhodium salt or its complex salt, iron salt or its complex salt, and the like.

Removal of a solubilized salt from the emulsion after formation of precipitates or their physical ripening may be carried out using the Nudel washing process by gelling gelatin, and also sedimentation process (flocculation) which utilizes inorganic salts, anionic surfactants, anionic polymers (e.g., polystyrenesulfonic acid), or gelatin derivatives (e.g., acylated gelatin, carbamoylated gelatin, etc.).

Chemical sensitization of silver halide emulsions can be achieved by, for example, the method described in Die Grundlagen der Photographischen Prozess mit Silberhalogenden, edited by H. Frieser (Akademische Verlagsgesellschaft, 1968), pp. 675–734.

Namely, the following processes can be used alone or in their combined form: sulfur sensitization process using a compound containing sulfur which can react with active gelatin and silver (e.g., thiosulfates, thioureas, mercapto compounds and rhodanines); reductive sensitization process using a reducing substance (e.g., stannous salts, amines, hydrazine derivatives, formamidinesulfinic acid and silane compounds); noble metal sensitization process using a noble metal compound (e.g., complex salts of metals in Group VIII of the periodical table such as Pt, Ir, Pd and the like, as well as gold complex salt) and the like.

The concrete examples of these processes are shown in each specification of U.S. Pat. Nos. 1,574,944, 2,410,689, 2,278,947, 2,728,668, 3,656,955 for sulfur sensitization process, of U.S. Pat. Nos. 2,983,609, 2,419,974, 4,054,458 for reductive sensitization process, and of U.S. Pat. Nos. 2,399,083, 2,448,060, and British Pat. No. 618,061 for noble metal sensitization process.

The photographic emulsions used in this invention may contain various compounds in order to prevent fog during the production step, preservation, or photographic processing of the photographic materials or to stabilize photographic efficiency. That is, many compounds known as antifogging agent or stabilizer may be added, such as azoles, e.g., benzothiazolium salts, nitroindazoles, triazoles, benzotriazoles and benzimidazoles (especially, nitro- or halogen substituted derivatives); heterocyclic mercapto compounds, e.g., mercaptothiazoles, mercaptobenzothiazoles, mercaptobenzimidazles, mercaptothiadiazoles, mercaptotetrazoles (especially, 1-phenyl-5-mercaptotetrazole) and mercaptopyrimidines; the heterocyclic mercapto compounds described above which have a water-soluble group such as carboxyl and sulfone groups; thioketo compounds, e.g., oxazolinethion; azaindenes, e.g., tetraazaindenes (especially, 4-hydroxy substituted (1,3,3a,7)tetraazaindenes; benzenethiosulfonic acids; benzenesulfinic acids and the like.

More detailed examples and uses are described in the specifications of U.S. Pat. Nos. 3,954,474, 3,982,947, 4,021,248 and the specification of Japanese Patent Publication No. 28660/77.

The photographic emulsion layers or other hydrophilic colloidal layers of the photographic material prepared using this invention may contain various surfactants for various objects such as coating auxiliary, prevention of electrification, improvement of sliding, emulsified dispersion, prevention of adhesion, and improvement of photographic characteristics (e.g., acceleration of development, substractivity and sensitization).

Examples of the surfactants include non-ionic surfactants such as saponin (steroid type), alkyleneoxide derivatives (e.g, polyethyleneglycol, polyethyleneglycol/polypropyleneglycol condensation products, polyethyleneglycol alkyl ethers, polyethyleneglycol alkylaryl ethers, polyethyleneglycol esters, polyethyleneglycol sorbitan esters, polyalkyleneglycol alkylamines or amides, and polyethyleneoxide adducts of silicone), glycidol derivatives (e.g., polyglyceride alkenylsuccinate and alkylphenol polyglyceride), fatty acid esters of polyhydric alcohols, alkylesters of sugars and the like; anionic surfactants containing acidic groups such as carboxy, sulfo, phospho, sulfuric acid ester and phosphoric ester groups, e.g., alkylcarboxylic acid salts, alkylsulfonic acid salts, alkylbenzenesulfonates, alkylnaphtholenesulfonates, alkylsulfric acid esters, alkylphosphoric acid esters, N-acyl-N-alkyltaurines, sulfosuccinates, sulfoalkylpolyoxyethylenealkylphenyl ethers, polyoxyethylenealkylphosphorates and the like; amphoteric surfactants such as amino acids, aminoalkylsulfonic acids, aminoalkylsulfonates or phosphorates, alkylbetaines; amineoxides and the like; cationic surfactants such as alkylamine salts, aliphatic or aromatic quarternary ammonium salts, heterocyclic quarternary ammonium salts, e.g., pyridinium and imidazolinium, and phosphonium or sulfonium salts containing aliphatics or heterocycles.

The photographic emulsion layers of the photographic material prepared using this invention may contain, for example, polyalkyleneoxides or their derivatives such as ethers, esters, amines and the like, thioether compounds, thiomorpholines, quarternary ammonium salt compounds, urethane derivatives, urea derivatives, imidazole derivatives, 3-pyrazolidones and the like, in order to increase sensitivity and contrast or accelerate development. Examples of these compounds are described in, for example, U.S. Pat. Nos. 2,400,532, 2,423,549, 2,716,062, 3,617,280, 3,772,021, 3,808,003, and British Pat. No. 1,488,991.

The photographic emulsion layers or other hydrophilic colloidal layers in the photographic material prepared using this invention may contain dispersion of synthetic polymers which are unsoluble or difficult to dissolve in water with the purpose of improvement of dimensional stability and the like. Examples of the polymers include those containing, as monomer component, alkyl (meta)acrylate, alkoxyalkyl(meta)acrylate, glycyl(meta)acrylate, (meta)acrylamide, vinyl ester (e.g., vinyl acetate), acrylonitrile, olefine, stylene and the like alone or in their combined form, or the combination of the above compounds with acrylic acid, metacrylic acid, $\alpha,\beta$-unsaturated dicarboxylic acid, hydroxyalkyl(meta)acrylate, sulfoalkyl(meta)acrylate, stylenesulfonic acid and the like. These compounds are shown in, for example, U.S. Pat. Nos. 2,376,005, 2,739,137, 2,853,457, 3,062,674, 3,411,911, 3,488,708, 3,525,620, 3,607,290, 3,635,715, 3,645,740, and British Pat. Nos. 1,186,699, 1,307,373.

Photographic processing of the layers consisting of the photographic emulsion prepared using this invention can be applied with any of the conventional methods and processing solutions as described in *Research Disclosure,* No. 176, pp. 28–30 (RD-17643). According to the purposes, this photographic processing may also be any photographic processings forming dye images (color photographic processing). The processing temperature is usually selected from between 18° C. and 50° C., but it may be lower than 18° C. or higher than 50° C. As a particular form of development processings, a photographic material, which contains a developing agent, for example, in the emulsion layer, may be subjected to processing in an alkaline aqueous solution. The hydrophobic development agents can be contained in an emulsion layer using various methods described in *Research Disclosure,* No. 169 (RD-16928), U.S. Pat. No. 2,739,890, British Pat. No. 813,253, German Pat. No. 1,547,763 and the like. Such processings may be combined with stabilization processing of silver salt by thiocyanic acid salt.

A fixing solution having the composition generally used can be employed. Examples of the fixing solution include organosulfur compounds which are known as effective fixer, in addition to thiosulfates and thiocyanates. The fixing solution may contain a water-soluble aluminum salt as a hardening agent.

The color image can be formed according to usual processes, for example, the negative-positive process (e.g., "Journal of the Society of Motion Picture and Television Engineers", Vol. 61 (1953), pp. 667–701).

A color developer generally consists of an alkaline aqueous solution containing a color developing agent. As the color developing agent, public-known primary aromatic amine developers can be used, such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfoamidoethylaniline, 4-amino-3-methyl-N-ethyl-N-$\beta$-methoxyethylaniline and the like).

In addition to the above, compounds described in the following references may be used; Photographic Processing Chemistry by L. F. A. Mason (Focal Press, 1966), pp. 226–229, U.S. Pat. Nos. 2,193,015, 2,592,364, Japanese Patent Application (OPI) No. 64933/73.

Moreover, the color developer can contain a pH buffer agent, a development restrainer, an anti-fog agent and the like. It may also, if ncessary, contain a hard-water softening agent, a preservative, an organic solvent, a development accelerator, a pigmentation coupler, a competitive coupler, fogging agent, a developing sub agent, a thickener, a polycarboxylic acid type chelating agent, an antioxidant and the like.

Examples of these additives are described in *Research Disclosure* (RD-17643) and also in U.S. Pat. No. 4,083,723, German Patent Application (OLS) No. 2,622,950, etc.

The photographic emulsion after coloring development is usually subjected to bleaching. Bleaching and fixing may be achieved simultaneously or separately. Examples of the bleaching agent include multivalent metal compounds such as iron (III), cobalt (III), chrome (VI), and copper (II), peracids, quinones, nitroso compounds and the like.

More particularly, they include ferricyanates; dichromates; organic complex salts of iron (III) or cobalt (III), e.g., complex salts of aminopolycarboxylic acids such as ethylenediaminetetraacetic acid, nitrilotriacetic acid and 1,3-diamino-2-propanoltetraacetic acid and the like, and organic acids such as citric acid, tartaric acid and malic acid and the like; persulfates and permanganates; nitrosophenol and the like. Among them, potassium ferricyanate, sodium salt of iron (III) ethylenediaminetetraacetate, and ammonium salt of iron (III) ethylenediaminetetraacetate are particularly effective. The iron (III) complex salts of ethylenediaminetetraacetic acid are useful in individual bleaching solution and also in monobath bleaching fixer.

Various additives can be added to the bleaching solution or bleaching fixing solution, such as bleaching accelerators described in U.S. Pat. Nos. 3,042,520, 3,241,966, and Japanese Patent Publication Nos. 8506/70, 8856/70, and thiol compounds described in Japanese Patent Application (OPI) No. 65732/78.

The photographic emulsions used in this invention may be spectrally sensitized by methyne dyes and others.

Examples of effective sensitizing dyes are described in German Pat. No. 929,080, U.S. Pat. Nos. 2,493,748, 2,503,776, 2,519,001, 2,912,329, 3,656,959, 3,672,897, 4,025,349, British Pat. No. 1,242,588, Japanese Patent Publication No. 14030/68.

These sensitizing dyes may be used according to usual methods or in their combined form, and particularly, the combination of sensitizing dyes is often used for supersensitization. The typical examples are shown in U.S. Pat. Nos. 2,688,545, 2,977,229, 3,397,060, 3,522,052, 3,527,641, 3,617,293, 3,628,964, 3,666,480, 3,672,898, 3,679,428, 3,814,609, 4,026,707, British Pat. No. 1,344,281, Japanese Patent Publication Nos. 4936/68, 12375/78, and Japanese Patent Application (OPI) Nos. 110618/77, 109925/77.

In the photographic material prepared using this invention, the photographic emulsion layers and other layers are coated on flexible supports such as plastic film, paper, and cloth which are usually used or on rigid supports such as glass, china and metal. Examples of useful flexible supports include films consisting of semi-synthetic or synthetic polymers such as cellulose nitrate, cellulose acetate, cellulose acetatelactate, polystylene, polyvinylchloride, polyethylene terephthalate, polycarbonate and the like, papers which are coated or laminated with baryta layer or α-olefin polymer (e.g., polyethylene, polypropylene, and ethylene/buten copolymer) and the like. The supports may be colored using dyes and pigments, and also be made black for interception of light. The surfaces of these supports are generally subjected to undercoating in order to make adhesion with photographic emulsion layers more effective. They may be also subjected to corona discharge, irradiation by ultraviolet rays, or flame treatment before or after undercoating.

In the photographic photosensitive material prepared using this invention, the photographic emulsion layers and other hydrophilic colloidal layers can be coated on supports or other layers according to various conventional coating methods. The coating can be carried out by dip coating method, roller coating method, curtain coating method, extrusion coating method and the like. The methods described in U.S. Pat. Nos. 2,681,294, 2,761,791, 3,526,528 are effectively used.

This invention can apply to multilayer polychromic photographic materials having at least two different spectral sensitivities. Multilayer color photographic materials generally have on the supports at least one of red, blue and green color sensitive emulsion layers, respectively. The order of these layers can be freely decided depending on the need. Generally, the red, green and blue sensitive emulsion layers contain a cyan-, magenta- and yellow-forming couplers, respectively, but these combinations can be changed as the case may be.

The exposure to get a photographic image may be carried out according to usual methods. Namely, various conventional sources of light can be used, such as natural light (sunlight), tangsten bulb, fluorescent lamp, mercury lamp, xenon arc lamp, carbon arc lamp, xenon flash lamp, cathode-ray tube flying spot and the like.

The exposure time may be shorter than 1/1000 sec., for example, $10^4$ to $1/10^6$ sec. in case of using xenon flash lamp and cathode ray tube, and longer then 1 sec., as well as 1/1000 sec. to 1 sec. generally used in the case of camera. The spectral composition of light used for exposure may be controlled by color filters, if necessary. Laser light can be used for exposure. Also, exposure may be achieved by light emitted from a fluorescent substance which is excited by electron beam, x-ray, γ-ray, α-ray and the like.

Besides the cyan coupler of this invention, other color-forming couplers can be used for photographic emulsion layers of the photographic material prepared using this invention. Namely, the compounds which can be colored by oxidative-coupling with aromatic primary amine developer (e.g., phenylenediamine derivatives and aminophenol derivatives), in color development processing may be used together with a polymer coupler latex, or used alone in a layer in which a polymer coupler latex is not used. Examples of magenta coupler include 5-pyrozolone coupler, pyrazolobenzimidazol coupler, cyanoacetylcumarone coupler, open-ring acylacetonitrile coupler and the like, examples of yellow coupler include acylacetamide coupler (e.g., benzoylacetanilides, pivaloylacetanilides) and the like, and examples of cyan coupler include naphthol coupler, phenol coupler and the like. These couplers are desirably non-diffusive ones having a hydrophobic group called as balast group in the molecule. The couplers may be used in the proportion of 4 or 2 equivalents per silver ion. Also, they may be colored couplers having an effect of color compensation or couplers releasing a development inhibiting reagent in the progress of development (so-called DIR coupler). They may contain, besides DIR coupler, a non-color presenting DIR coupling compound which affords a colorless product by coupling reaction and releases a development inhibiting reagent.

The total amount of cyan couplers used can be in the range of from $2\times10^{-3}$ mole to $5\times10^{-1}$ mole per mole of silver.

Specific examples of magenta coloring couplers are shown in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, German Pat. No. 1,810,464, German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, 55122/78, and the like.

Specific examples of yellow coloring couplers are shown in U.S. Pat. Nos. 2,875,057, 3,265,506, 3,408,194, 3,551,155, 3,582,322, 3,725,072, 3,891,445, German Pat. No. 1,547,868, German Patent Application (OLS) Nos. 2,219,917, 2,261,361, 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, and the like.

Specific examples of cyan couplers are shown in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, German Patent Application (OLS) Nos. 2,414,830, 2,454,329, Japanese Patent Application (OPI) Nos. 59838/73, 26034/76, 5055/73, 146828/76, 69624/77, 90932/77.

Examples of colored couplers include U.S. Pat. Nos. 3,476,560, 2,521,908, 3,034,892, Japanese Patent Publication Nos. 2016/69, 22335/63, 11304/67, 32461/69, the specifications of Japanese Patent Application (OPI) Nos. 26034/76 and 42121/77, and German Patent Application (OLS) No. 2,418,959.

Examples of DIR couplers include U.S. Pat. Nos. 3,227,554, 3,617,291, 3,701,783, 3,790,384, 3,632,345, German Patent Application (OLS) Nos. 2,414,006, 2,454,301, 2,454,329, British Pat. No. 953,454, Japanese Patent Application (OPI) Nos. 69624/77, 122335/74, and Japanese Patent Publication No. 16141/76.

The photographic material may contain, besides DIR coupler, a compound releasing a development inhibiting reagent in the progress of development. For example, the compounds described in U.S. Pat. Nos. 3,297,445, 3,379,529, German Patent Application (OLS) No. 2,417,914, Japanese Patent Application (OPI) Nos. 15271/77, 9116/78 may be used.

The photographic material prepared using this invention may contain an inorganic or organic hardening agent in the photographic emulsion layers and other hydrophilic colloidal layers. For example, the following compounds can be used alone or in their combined form; chrome salts (chrome alum, chrome acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.) and the like.

In the photographic material prepared using this invention, when the hydrophilic colloidal layer contains dyes, ultraviolet-ray absorbents and the like, they may be mordanted by cationic polymers. For example, the polymers described in British Pat. No. 685,475, U.S. Pat. Nos. 2,675,316, 2,839,401, 2,882,156, 3,048,487, 3,184,309, 3,445,231, German Patent Application (OLS) No. 1,914,362, Japanese Patent Application (OPI) Nos. 47624/75, 71332/75, and the like may be used.

The photographic material prepared using this invention may contain hydroquinone derivatives, amino phenol derivatives, gallic acid derivatives, ascorbic acid derivatives and the like as anti color-fogging agent.

The photographic material prepared using this invention may contain ultraviolet-ray absorbents in the hydrophilic colloidal layer. Examples of the absorbent include 4-thiazolidone compounds, benzophenone compounds, cinnamic acid ester compounds, butadiene compounds, benzooxazole compounds, and benzotriazole compounds substituted by aryl groups as well as ultraviolet-ray absorptive polymers: The ultraviolet-ray absorbents may be fixed in the above hydrophilic colloidal layer.

Specific examples of the ultraviolet-ray absorbents are described in U.S. Pat. Nos. 3,533,794, 3,314,794, 3,352,681, Japanese Patent Application (OPI) No. 2784/71, U.S. Pat. Nos. 3,705,805, 3,707,375, 4,045,229, 3,700,455, 3,499,762, German Patent Publication No. 1,547,863 and the like.

The photographic material prepared using this invention may contain water-soluble dyes in the hydrophilic colloidal layer as filter dye or with the purposes of preventing irradiation and the like. Examples of these dyes include oxonole dyes, hemioxonole dyes, styryl dyes, merocyanine dyes, cyanine dyes and azo dyes. Among them, oxonole dyes hemioxonol dyes and merocyanine dyes are effectively used.

In carrying out this invention, the following conventional anti-fading agents can be used together, and color-image stabilizers used in this invention can be used alone or in a combination of two or more. Examples of the conventional anti-feding agents include hydroquinone derivatives, gallic acid derivatives, p-alkoxyphenols, p-oxyphenyol derivatives and bisphenols.

Specific examples of hydroquinone derivatives are described in U.S. Pat. Nos. 2,360,290, 2,418,613, 2,675,314, 2,701,197, 2,704,713, 2,728,659, 2,732,300, 2,735,765, 2,710,801, 2,816,028, British Pat. No. 1,363,921, and the like, for gallic acid derivatives in U.S. Pat. Nos. 3,457,079, 3,069,262 and the like. Examples of p-alkoxyphenols are described in U.S. Pat. Nos. 2,735,765, 3,698,909, Japanese Patent Publication Nos. 20977/74, 6623/77, p-oxyphenol derivatives are described in U.S. Pat. Nos. 3,432,300, 3,573,050, 3,574,627, 3,764,337, Japanese Patent Application (OPI) Nos. 35633/77, 147434/77, 152225/77, and bisphenols are described in U.S. Pat. No. 700,455.

WORKING EXAMPLE 1

The multilayer color photosensitive material consisting of the following layers was prepared on a cellulosetriacetate film support.

1st layer: Anti-halation layer. Gelatin layer containing black colloidal silver.

2nd layer: Internal layer. Gelatin layer containing emulsified dispersion of 2,5-di-n-pentadecylhydroquinone.

3rd layer: Red color low-sensitive silver halide emulsion layer.
- Silver iodide bromide emulsion (silver iodide 5 mol%, average grain size 0.7μ) . . . Coating amount of silver 1.3 g/m$^2$.
- Sensitizing dye I . . . $6\times10^{-5}$ mol per mol of silver.
- Sensitizing dye II . . . $1.5\times10^{-5}$ mol per mol of silver.
- Coupler 2 . . . 0.04 mol per mol of silver.
- Coupler D . . . 0.003 mol per mol of silver.

4th layer: Red color middle sensitive silver halide emulsion layer.
- Silver iodide bromide emulsion (silver iodide 5.5 mol% average grain size 0.9μ) . . . Coating amount of silver 1.3 g/m$^2$.
- Sensitizing dye I . . . $5\times10^{-5}$ mol per mol of silver.
- Sensitizing dye II . . . $1.2\times10^{-5}$ mol per mol of silver.
- Coupler 2 . . . 0.04 mol per mol of silver.
- Coupler C-2 . . . 0.004 mol per mol of silver.
- Coupler D . . . 0.001 mol per mol of silver.

5th layer: Red color high sensitive silver halide emulsion layer.
- Silver iodide bromide (silver iodide 8 mol%, average grain size 1.2μ) . . . Coating amount of silver 1.5 g/m$^2$.
- Sensitizing dye I . . . $5\times10^{-5}$ mol per mol of silver.
- Sensitizing dye II . . . $1.2\times10^{-5}$ mol per mol of silver.
- Coupler C-1 . . . 0.012 mol per mol of silver.
- Coupler C-3 . . . 0.002 mol per mol of silver.

6th layer: Internal layer: The same as the 2nd layer.

7th layer: Green color low sensitive silver halide emulsion layer.
- Silver iodide bromide emulsion (silver iodide 5 mol%, average grain size 0.7μ) . . . Coating amount of silver 0.7 g/m$^2$.
- Sensitizing dye III . . . $3\times10^{-5}$ mol per mol of silver.
- Sensitizing dye IV . . . $1\times10^{-5}$ mol per mol of silver.
- Coupler M-1 . . . 0.12 mol, regarding 1 unit of active point as 1 mol per mol of silver.
- Coupler M-2 . . . 0.012 mol per mol of silver.
- Coupler M-3 . . . 0.06 mol per mol of silver.
- Coupler D . . . 0.012 mol per mol of silver.

8th layer: Green color middle sensitive silver halide emulsion layer.
- Silver iodide bromide (silver iodide 5 mol%, average grain size 0.9μ) . . . Coating amount of silver 2.5 g/m$^2$.
- Sensitizing dye III . . . $2.5\times10$ mol per mol of silver.
- Sensitizing dye IV . . . $0.8\times10$ mol per mol of silver.
- Coupler M-4 . . . 0.05 mol per mol of silver.
- Coupler M-2 . . . 0.005 mol per mol of silver.
- Coupler D . . . 0.001 mol per mol of silver.
- Coupler M-3 . . . 0.005 mol per mol of silver.
- Coupler M-5 . . . 0.02 mol per mol of silver.

9th layer: Green color high sensitive silver halide emulsion layer.
- Silver iodide bromide emulsion (silver iodide 8 mol%, average grain size 1.1μ) . . . Coating amount of silver 3.0 g/m$^2$.
- Sensitizing dye III . . . $2.1\times10$ mol per mol of silver.
- Sensitizing dye IV . . . $0.7\times10$ mol per mol of silver.
- Coupler M-5 . . . 0.0125 mol per mol of silver.
- Coupler M-2 . . . 0.002 mol per mol of silver.

10th layer: Yellow filter layer. Gelatin layer containing emulsified dispersion of gelatin, yellow colloidal silver, and 2,5-di-n-pentadecylhydroquinone.

11th layer: Blue color low sensitive silver halide emulsion layer.

Silver iodide bromide (silver iodide 5 mol%, average grain size 0.7μ) . . . Coating amount of silver 0.3 g/m$^2$.

Coupler Y . . . 0.2 mol per mol of silver.

Coupler D . . . 0.02 mol per mol of silver.

12th layer: Blue color middle sensitive silver halide emulsion layer.

Silver iodide bromide (silver iodide 6 mol%, average grain size 0.9μ) . . . Coating amount of silver 0.4 g/m$^2$.

Coupler Y . . . 0.01 mol per mol of silver.

13th layer: Blue color high sensitive silver halide emulsion layer.

Silver iodide bromide (silver iodide 8.5 mol%, average grain size 1.4μ) . . . Coating amount of silver 0.8 g/m$^2$.

Coupler Y . . . 0.05 mol per mol of silver.

14th layer: 1st protective layer. Gelatin layer containing emulsified dispersion which contain ultraviolet-ray absorbents UV-1 and UV-2 of the equal weight.

15th layer: Gelatin layer containing trimethylmetaacrylate grain (diameter about 1.5μ).

The couplers in each layer were prepared for use by adding a predetermined amount of the coupler to a solution of tricrezylphosphate and ethyl acetate, dissolving sodium p-dodecylbenzenesulfonate as emulsifier with heating, followed by mixing with a heated 10% gelatin solution, and emulsifying with colloidmill.

In addition to the above composition, a gelatin hardener, a surfactant and the like were added to each layer.

The sample thus prepared was called Sample 101.

Compounds Used for Preparing Samples

Sensitizing dye I: anhydro-5 5'-dichloro-3 3'-di-(γ-sulfopropyl)-9-ethyl-thiacarbocyaninehydroxide pyridinium salt.

Sensitizing dye II: anhydro-9-ethyl-3 3'-di-(γ-sulfopropyl)-4.5.4'.5'-dibenzothiacarbocyaninehydroxide triethylamine salt.

Sensitizing dye III: anhydro-9-ethyl-5.5'-dichloro-3 3'di-(γ-sulfopropyl)oxacarbocyanine sodium salt.

Sensitizing dye IV: anhydro-5.6.5'.6'-tetrachloro-1 1'-diethyl-3.3'-di-{β-[β-(γ-sulfopropoxy)ethoxy]}ethylimidazolcarbocyaninehydroxide sodium salt.

Coupler C-1

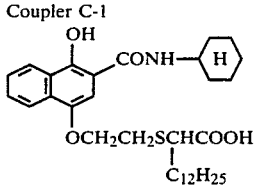

Coupler C-2

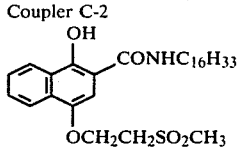

Coupler C-3

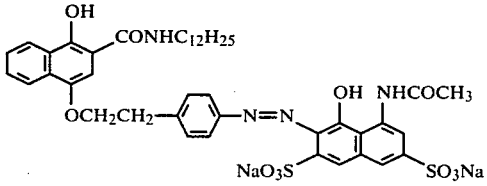

Coupler M-1

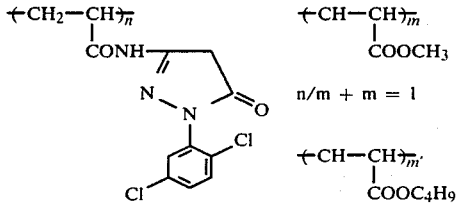

Molecular weight: about 40,000 m/m' = 1 (Weight ratio)

Coupler M-2

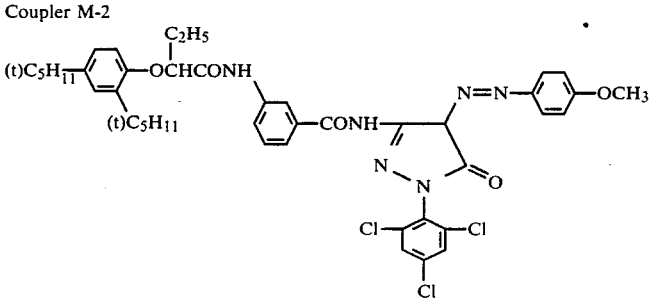

Coupler M-3

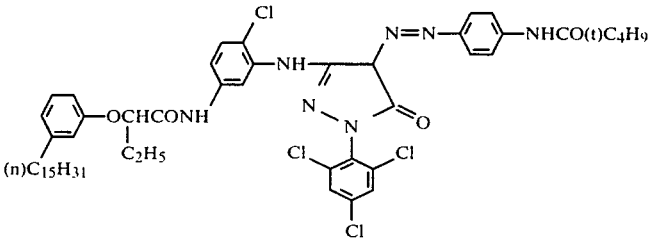

Coupler M-4

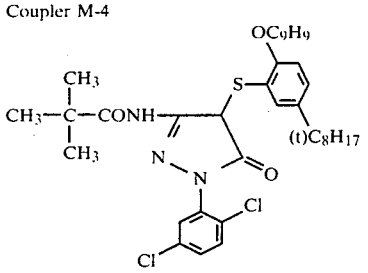

Coupler Y

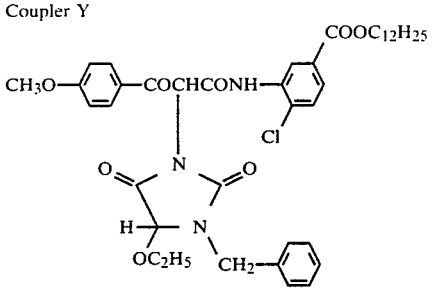

UV-2

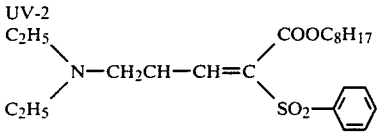

-continued

Coupler M-5

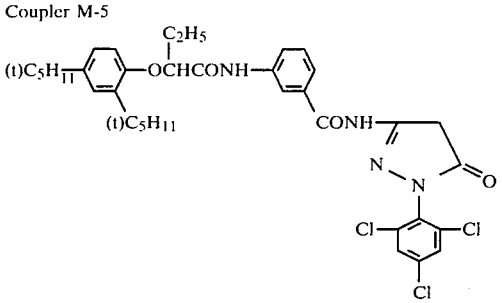

UV-1

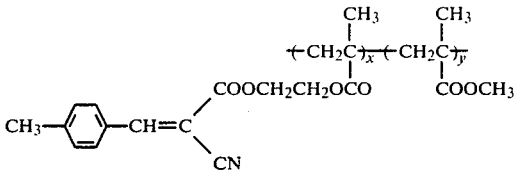

x/y = 7/3 (Weight ratio)

Coupler D

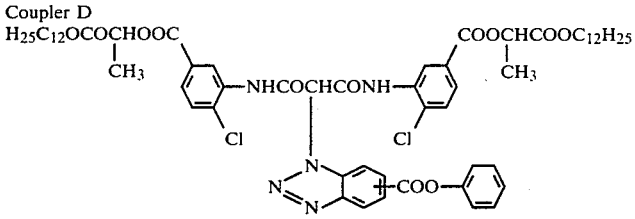

Preparation of Sample 102

It was prepared in a similar manner as Sample 101 except for adding Coupler 2, instead of Coupler C-1 in the 5th layer of Sample 101, in two times mol of Coupler C-1.

Preparation of Sample 103

Sample 102 was prepared by adding fine grain silver iodide bromide emulsion (silver iodide 0.5 mol%, average grain size 0.07μ) to the gelatin middle layer of the 6th layer in Example 102 and coating so that the silver coating amount was 0.2 g/m$^2$.

Preparations of Samples 104–110

These samples were prepared by replacing Coupler 2 in the 5th layer of Sample 103 with the equal mol of couplers in Table 1 and changing the amount of the fine grain emulsion in the 6th layer to those shown in Table 1.

Preparation of Sample 111

Sample 107 was prepared by coating the gelatin internal layer containing the fine grain emulsion 0.5 g/m$^2$ used in Sample 102 between the 4th layer and the 5th layer of Sample 102.

Preparation of Sample 112

Sample 112 was prepared by adding the fine grain emulsion 0.5 g/m$^2$ used in Sample 103 to the 4th layer of Sample 102.

The obtained Samples 101–112 were wedge-exposed with white light and subjected to the following development processing at 38° C.

| | | |
|---|---|---|
| 1. | Color development | 3'15" |
| 2. | Bleaching | 6'30" |
| 3. | Washing | 3'15" |
| 4. | Fixation | 6'30" |
| 5. | Washing | 3'15" |
| 6. | Stabilization | 3'15" |

The compositions of processing solutions used in each step are as follows:

| | |
|---|---|
| Color Developer | |
| Sodium nitrotriacetate | 1.0 g |
| Sodium sulfite | 4.0 g |
| Sodium carbonate | 30.0 g |
| Potassium bromide | 1.4 g |
| Hydroxylaminesulfate | 2.4 g |
| 4-(N—Ethyl-N—β-hydroxyethylamino)-2-methyl-anilinesulfate | 4.5 g |
| Water to make total volume | 1 l |
| Bleaching Solution | |
| Ammonium bromide | 160.0 g |
| Aqueous ammonium (28%) | 25.0 ml |
| Ethylenediamine-sodium tetraacetate iron salt | 130 g |
| Glacial acetic acid | 14 ml |
| Water to make total volume | 1 l |
| Fixer | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make total volume | 1 l |

-continued

| Stabilizer | |
|---|---|
| Formalin | 8.0 ml |
| Water to make total volume | 1 l |

The sensitivity of cyan color images of Samples 101 to 112 is summarized in Table 1. Table 1 apparently indicates that, when the ureido type couplers are used according to the embodiments of this invention, the sensitivity in the leg part increases and becomes equal to that in the case of using a high-speed reactive coupler.

Next, color image stability of each sample after development was examined. The depression in density of cyan color images which were preserved at 100° C. under dry atmosphere in dark place for 3 days is summarized in Table 1.

The samples using ureido type couplers of this invention indicated quite excellent image stability and could afford photosensitive materials with high sensitivity and image stability.

TABLE 1

| Sample No. | | Coupler in 5th Layer | Coating Amount of Fine Grain Emulsion ($g/m^2$) | Coating Layer of Fine Grain Emulsion | ΔS0.2 + Fog* | Residual Ratio of Dye at the Point of Density 1.0 100° C. - dry 3 days |
|---|---|---|---|---|---|---|
| 101 | Comparative Example | C-4 | — | — | +0.10 | 73 |
| 102 | Comparative Example | 2 | — | — | ±0 | 90 |
| 103 | This Invention | " | 0.2 | 6th layer | +0.06 | 92 |
| 104 | This invention | " | 0.5 | " | +0.10 | 93 |
| 105 | Comparative Example | 12 | — | " | +0.01 | 92 |
| 106 | This Invention | " | 0.2 | " | +0.07 | 91 |
| 107 | This Invention | " | 0.5 | " | +0.10 | 92 |
| 108 | Comparative Example | 18 | — | " | −0.01 | 93 |
| 109 | This Invention | " | 0.2 | " | +0.06 | 92 |
| 110 | This Invention | " | 0.5 | " | +0.09 | 92 |
| 111 | This Invention | 2 | 0.5 | between 4th layer and 5th layer | +0.11 | 94 |
| 112 | This Invention | " | 0.5 | 4th layer | +0.12 | 92 |

*The difference in sensitivity at fog density 0.2 is indicated by log E, using Sample 102 as a standard.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising:

a support having coated thereon;

at least one layer of silver halide emulsion containing a phenolic cyan coupler which is substituted by an acylamino group at the 5-position and by an ureido group at the 2-position; and at least one layer, adjacent to said coupler-containing layer, containing a fine grain silver halide emulsion.

2. A silver halide color photographic material as claimed in claim 1, wherein the phenolic cyan coupler is a coupler represented by the general formula (I):

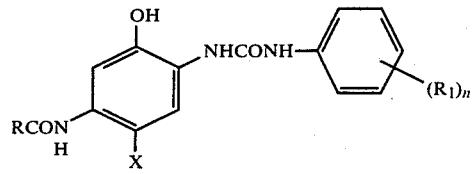

wherein R is an alkyl group, an aryl group or a heterocyclic group, which may be substituted, $R_1$ is a group selected from the group consisting of a hydrogen atom, a halogen atom, a sulfonyl group, a sulfonamide group, a sulfamoyl group, a polyfluoroalkyl group, an acyl group, an alkoxycarbonyl group, an acylamino group and a cyano group, n is an integer of 1 to 5, $R_1$ may be the same or different when n is 2 or more, and X is a group which can be eliminated at oxidative-coupling with a developing agent.

3. A silver halide color photographic material as claimed in claim 2, wherein R is a cyclic or alicyclic alkyl group containing 1 to 22 carbon atoms.

4. A silver halide color photographic materials as claimed in claim 2, wherein $R_1$ is a halogen atom, a sulfonyl group, a sulfonamido group, a sulfamoyl group, a polyfluoroalkyl group, an acyl group, an alkoxycarbonyl group or an acylamino group, n is 1 or 2, and the substituents are located at the m- or p-position with respect to the ureido group.

5. A silver halide color photographic material as claimed in claim 2, wherein $R_1$ is a sulfonyl group, a sulfonamido group, or a sulfamoyl group and n is 1.

6. A silver halide color photographic material as claimed in claim 2, wherein X is a hydrogen atom, a halogen atom, an alkoxy group, an aryloxy group, an acyloxy group, a sulfonyloxy group, an amido group, an alkoxycarbonyloxy group, an aryloxycarbonyloxy group or an imido group.

* * * * *